US009490561B2

(12) United States Patent
Brusco et al.

(10) Patent No.: US 9,490,561 B2
(45) Date of Patent: Nov. 8, 2016

(54) ELECTRICAL PLUG CONTACT WITH CONDUCTIVE PLASTIC AND REDUCED CONTACT RESISTANCE

(71) Applicant: Röchling Automotive SE & Co. KG, Mannheim (DE)

(72) Inventors: Mirco Brusco, Leifers (IT); Ferdinand Di Pauli, Bozen (IT)

(73) Assignee: Röchling Automotive SE & Co. KG, Mannheim (DE)

( * ) Notice: Subject to any disclaimer, the term of this patent is extended or adjusted under 35 U.S.C. 154(b) by 0 days.

(21) Appl. No.: 14/791,229

(22) Filed: Jul. 2, 2015

(65) Prior Publication Data

US 2016/0006154 A1 Jan. 7, 2016

(30) Foreign Application Priority Data

Jul. 4, 2014 (DE) ..... 10 2014 213 079

(51) Int. Cl.
*H01R 4/58* (2006.01)
*H01R 13/03* (2006.01)

(52) U.S. Cl.
CPC ..... *H01R 13/035* (2013.01)

(58) Field of Classification Search
CPC .... H01R 13/04; H01R 13/11; H01R 13/115; H01R 13/35
USPC ..... 439/520, 86, 722, 387, 931
See application file for complete search history.

(56) References Cited

U.S. PATENT DOCUMENTS 3,192,498 A * 6/1965 Ruehlemann ..... H01R 13/111 439/223
3,585,573 A * 6/1971 Robshaw ..... H01H 1/36 439/886
3,601,774 A * 8/1971 Stathos ..... H01R 12/721 439/637
4,734,041 A * 3/1988 Bruchmann ..... H01R 12/82 439/637
5,736,191 A 4/1998 Biernath (Continued)

FOREIGN PATENT DOCUMENTS

DE 20 2012 008 961 U1 10/2012
JP 2006-172877 A 6/2006

(Continued)

OTHER PUBLICATIONS

German Search Report for corresponding DE 10 2014 213 079.4 mailed Mar. 23, 2015, 9 pgs.

*Primary Examiner* — Tulsidas C Patel
*Assistant Examiner* — Peter G Leigh
(74) *Attorney, Agent, or Firm* — Rankin, Hill & Clark LLP

(57) ABSTRACT

The present invention concerns an electrical plug contact (110), which can be connected in electrically conducting manner with a mating plug contact (40), wherein the plug contact (10) in at least one contact section (18), which is configured for the direct electrically conductive contacting with the mating plug contact (40), comprises a plastic filled with electrically conductive filler material, wherein the contact section (18) has an exposed contact surface (18*a*) formed from the plastic filled with the electrically conductive filler material, characterized in that the contact surface (18*a*) has a base region (24) and a sacrificial projection region with at least one sacrificial projection (22) opposite the base region (24) and pointing away from its surface, which is designed to be at least partly removed when making an electrical connection with the mating plug contact (40).

14 Claims, 2 Drawing Sheets

(56) References Cited

U.S. PATENT DOCUMENTS 5,989,053 A * 11/1999 Wheeler ..... H01R 13/04 439/387
6,056,603 A * 5/2000 Pauza ..... H01R 43/20 439/733.1
6,652,322 B2 * 11/2003 Ito ..... H01R 12/721 439/637
7,229,321 B2 * 6/2007 Hegel ..... H01R 13/112 439/637
7,901,595 B2 * 3/2011 Vilkman ..... C08F 283/00 252/511
9,281,598 B2 * 3/2016 Zebhauser ..... H01R 13/111
9,343,835 B2 * 5/2016 Sasaki ..... H01R 13/2457
2003/0199179 A1 * 10/2003 Dozier, II ..... G01R 1/06727 439/66
2006/0027790 A1 * 2/2006 Arai ..... H01B 1/24 252/500
2010/0156723 A1 * 6/2010 Luch ..... G06K 19/07749 343/700 MS
2011/0151709 A1 * 6/2011 Kim ..... H01R 12/57 439/492
2015/0180151 A1 6/2015 Sawada et al.
2015/0229058 A1 8/2015 Zebhauser et al.

FOREIGN PATENT DOCUMENTS

JP 2014-053119 A 3/2014
WO 96/03851 A1 2/1996

* cited by examiner

ELECTRICAL PLUG CONTACT WITH CONDUCTIVE PLASTIC AND REDUCED CONTACT RESISTANCE

The present invention concerns an electrical plug contact, which can be connected in electrically conducting manner with a mating plug contact, wherein the plug contact in at least one contact section which is configured for the direct electrically conductive contacting with the mating plug contact comprises a plastic filled with electrically conductive filler material, wherein the contact section has an exposed contact surface formed from the plastic filled with the electrically conductive filler material.

The present invention furthermore concerns a subassembly formed from a mating plug contact and an electrical plug contact, as mentioned above.

BACKGROUND OF THE INVENTION

Electrical plug connections such as contact shoes and the contact tongues which can be shoved into them are generally known in the prior art.

Often electrical plug contacts are made from electrically conductive plastic for easier fabrication, such as in an injection molding process. The electrical conductivity of the plastic used is accomplished in this case by mixing in electrically conducting filler material in the plastic mass. A sufficiently high degree of filling of the plastic with electrically conductive filler material must be assured so that electrical conduction pathways are formed in the plastic by contacting particles of filler material.

The drawback to plug contacts made from electrically conductive plastic in the prior art is that, when the plug contacts or at least the contact sections with the exposed contact surfaces, which can thus make contact with mating contacts, are formed in the injection molding process, say, only very few electrically conductive particles of filler material are in fact exposed at the contact surface and are available for contacting by a mating plug contact. Instead, primarily the flowable plastic advances from the mixture of plastic and filler material during the injection molding as far as the wall of the mold cavity, while the electrically conductive filler material generally remains behind the contact surface thus formed. The result is that the contact surface, which is actually intended for the electrically conductive contacting with the mating plug contact, is formed essentially by a thin plastic skin, which results in an undesirably high electrical contact resistance.

SUMMARY OF THE INVENTION

The invention of this application solves the problems in the art by modifying the electrical plug contact of this kind so that the plug contact during the making of an electrically conductive connection as intended with a mating plug contact has a lower contact resistance as compared to the prior art.

More particularly, this problem is solved by an electrical plug contact of the kind mentioned above, in which the contact surface has a base region and a sacrificial projection region opposite the base region and pointing away from its surface, which is designed to be at least partly removed when making an electrical connection with the mating plug contact.

Because at least one sacrificial projection stands out from the base region of the contact surface, being configured to be at least partly removed upon making an electrical connection with the mating plug contact, the contact resistance between plug contact and mating plug contact can be reduced substantially as compared to the prior art, since the at least partial removal of the sacrificial projection leads to an exposing of electrically conductive filler material in the plastic matrix.

Although the exposed contact surface of the plug contact, formed from a plastic filled with electrically conductive filler material, without further measures will also have in all likelihood an excessively large fraction of plastic or an excessively low fraction of electrically conductive filler material per unit of volume—and therefore it is also often call a "plastic (outer) skin"—nevertheless there are already electrically conductive filler particles in sufficient degree directly beneath the exposed contact surface. Thus, if the sacrificial projection and thus the "plastic (outer) skin" covering it is at least partly removed, the electrically conductive filler particles present beneath the outer surface of the originally intact sacrificial projection are exposed and can make electrically conductive contact with a mating plug contact.

The at least partial removal of the sacrificial projection is essentially a reduction in the dimension of the projection by which the sacrificial projection sticks out from the base region. The removal is preferably by abrasion, so that material is separated from the at least one sacrificial projection.

Basically the idea behind the providing of the at least one sacrificial projection, which sticks out from a base region of the contact surface, can be to facilitate the making of an electrically conductive connection with a mating plug contact for the person working with the plug contact, in that it is enough for the person to draw a sharp blade, such as a pocket knife or some other customary tool of electricians, across the base region with the at least one sacrificial projection, and thereby at least partly remove the sacrificial projection. Thanks to the sacrificial projection, at first the blade will only lie against the tips at the end of the sacrificial projection pointing away from the base region, so that a very large pressure can be exerted locally here without any major expenditure of force. With this large pressure, the partial removal of the sacrificial projection—starting from the protruding end of the sacrificial projection pointing away from the base region—is possible without major expenditure of force.

However, it is preferable for a person working with the plug contact in question not to require any additional tool for the at least partial removal of the at least one sacrificial projection. Therefore, the at least one sacrificial projection according to one advantageous modification of the present invention can be configured so that it is at least partly, preferably entirely removed by a region of the mating plug contact when making an electrical connection with the mating plug contact.

For example, the mating plug contact can have an edge by which the at least one sacrificial projection can be at least partly removed. The mating plug contact can then remove material, acting like a plane.

For easier handling of the plug contact, it can advantageously be joined in electrically conductive contact with the mating plug contact by being shoved onto or into the mating plug contact along a sliding axis. Therefore, it can be advantageous to provide a leading edge of the mating contact plug in the shoving along the sliding axis, as an abrading edge, which is led across the at least one protruding sacrificial projection upon shoving the electrical plug contact onto or into the mating plug contact and thereby at least partly removes material of the sacrificial projection from the contact section of the plug contact. In this case, the making of an electrically conductive connection with a suitable mating plug contact inevitably results in the desired at least partial removal of the at least one sacrificial projection.

This at least partial removal of the at least one sacrificial projection from the contact section of the electrical plug contact can be supported without any additional measures in that the at least one sacrificial projection stands out from the base region in a projecting direction with a principal component orthogonal to the sliding axis. "Principal component" means here that this component is the largest in magnitude of possible mutually orthogonal components of the projecting direction. For example, the projecting direction may be slightly tilted along the sliding axis when the contact surface and its base region are arranged in the sense of an insertion offset to facilitate the introducing of the contact section into the mating plug contact.

However, it is also basically conceivable for the projecting direction to run essentially parallel to the sliding axis. Then the at least one sacrificial projection is provided on an end face of the plug contact pointing in the axial direction. In this case, the at least one sacrificial projection can be introduced into the mating plug contact until the end face provided with the sacrificial projection comes to lie against an abutment surface of the mating plug contact and the at least one sacrificial projection is partly or completely removed by relative movement orthogonal to the insertion movement, especially relative rotation of plug contact and mating plug contact to each other about the sliding axis as the axis of relative rotation. For this, it is advantageous for the abutment surface to have an abrading edge, against which the sacrificial projection comes to lie in the inserted state. The latter case, however, is less preferred compared to the former case, in which the sacrificial projection stands out essentially orthogonally to the sliding axis from the base region.

To ensure the largest possible contact surface between the mating plug contact and electrically conductive filler particles exposed by at least partial removal in the contact section of the electrical plug contact, it can be provided as a further modification of the present invention that the sacrificial projection region comprises a plurality of separate sacrificial projections. The at least one sacrificial projection can be configured as a pointlike eminence, roughly in the shape of a cone, a truncated cone, a cylinder, or a shape similarly extending in the direction away from the base region and possibly tapering.

Likewise, the sacrificial projection can be configured as a line-shaped eminence which runs along the contact surface. The latter variant offers the advantage that, when properly oriented, the sacrificial projection is moved with greater likelihood against an abrading edge of the mating plug contact when making an electrically conductive connection.

An especially high probability that at least one section of the sacrificial projection is at least partly removed by a region of the mating plug contact at least partly when making the electrical connection can be achieved in that the at least one sacrificial projection as a line-shaped eminence extends along an axial section of the contact surface oscillating in wavelike or zig zag fashion in a direction orthogonal to the sliding axis and to the projecting direction. Furthermore, the sacrificial projection is configured as a preferably line-shaped eminence, i.e., it has a substantially larger dimension along its line-shaped course than in the projecting direction and in a width direction of the at least one sacrificial projection orthogonal to the projecting direction and the extension direction of the line-shaped eminence. Thus, the resistance to a relative movement of plug contact and mating plug contact which occurs due to the partial removal of the sacrificial projection when making the electrical connection can be kept small.

On the one hand, in order to make the sacrificial projection noticeable as such, it is necessary for the projecting dimension, i.e., the dimension of the at least one sacrificial projection in the projecting direction away from the base region of the contact surface, to be larger than the mean peak to valley dimension of the contact surface in the base region.

On the other hand, if the relative movement between plug contact and mating plug contact should not be needlessly difficult, especially when the at least partial removal of the sacrificial projection by a region of the mating plug contact occurs during the making of an electrical connection between mating plug contact and plug contact, it is advantageous for the projecting dimension to be smaller than 0.7 mm. An even less noticeable resistance when shoving the plug contact onto or into a mating plug contact along the sliding axis is obtained with a projecting dimension smaller than 0.5 mm, especially preferably smaller than 0.3 mm.

During a relative movement between plug contact and mating plug contact which is executed to make an electrically conductive connection between the latter, preferably along the sliding axis, the mechanical resistance to movement produced by the at least partial removal of the sacrificial projection region or the force needed to make the electrically conductive connection by relative movement can be kept essentially constant over the entire relative movement if the projecting dimension of the at least one sacrificial projection is constant along the relative movement path traveled when making an electrically conductive connection of plug contact and mating plug contact. Preferably, the relative movement path is the aforementioned sliding axis, which is especially preferably a straight line, so that a unidimensional relative movement can be enough to make an electrically conductive connection between plug contact and mating plug contact.

Alternatively to this, and abandoning the idea of an expenditure of force which is constant over time when making an electrically conductive connection between plug contact and mating plug contact, the likelihood of removing a sufficient piece of the sacrificial projection, at least in one section thereof, is increased in that the projecting dimension of the at least one sacrificial projection along a path of relative movement between plug contact and mating plug contact that is traveled when making an electrically conductive connection between the latter, preferably along the sliding axis, becomes greater in the direction of increasing overlap between plug contact and mating plug contact. However, the force during the relative movement needed for a complete execution of the relative movement then increases.

It may be desirable for the at least one sacrificial projection to not hinder a "threading" of plug contact and mating plug contact into each other in preparation for a relative motion after the "threading" to make an electrically conductive connection. In this case, it can be advantageous for an inserting end configured for the shoving into or onto the mating plug contact and an adjacent axial inserting region to be free of sacrificial projections.

The circumstance that a region of the contact section comprising a plastic filled with electrically conductive filler material which is situated entirely on the outside will have a smaller fraction of electrically conductive filler material than regions of the filled plastic located further inward in the piece, combined with the slight advantageous projecting dimension in the range of a few hundredths to a few tenths of a millimeter, can mean that the at least one sacrificial projection—as compared to the rest of the contact section formed from the plastic filled with the electrically conductive filler material—has a smaller fraction of filler material than the rest of the contact section. The sacrificial projection then consists in a significant fraction of the aforementioned "plastic (outer) skin", which is supposed to be abraded during the at least partial removal of the contact section.

As explained above, the present invention also concerns a subassembly of a mating plug contact and an electrical plug contact, as was described above with further modifications.

A secure configuration of the mating plug contact for the making of an electrically conductive connection with the plug contact on the one hand and for the abrasive at least partial removal of the at least one sacrificial projection on the plug contact on the other hand can be achieved in that the mating plug contact is formed of metal at least for a segment.

On the one hand, the metal is hard enough for a margin or edge to be formed on it, by which the filled plastic material of the at least one sacrificial projection can be removed at least partly from the contact section of the plug contact, and on the other hand the metal can make direct electrically conductive contact with the contact section of the plug contact.

For the latter reason, the mating plug contact is preferably formed of metal at least in a mating contact section of the mating plug contact configured for the direct electrically conductive contacting of the contact section.

Preferably, a margin of the mating plug contact is formed of metal, in order to at least partly remove by this margin the at least one sacrificial projection when making the electrically conductive connection. This is preferably a margin of the mating plug contact which moves in advance in a relative movement direction of a relative movement between plug contact and mating plug contact to make an electrically conducting connection between the latter. Preferably, the relative movement direction runs along the aforementioned sliding axis.

The mating plug contact can be configured as a contact shoe in familiar fashion, into which the electrical plug contact is shoved, being for example a contact tongue.

The mating plug contact can act as a kind of plane or blade for the at least partial removal of the at least one sacrificial projection, which partly or entirely separates the at least one sacrificial projection from the rest of the plug contact when the plug contact and mating plug contact are brought together.

These and other objects, aspects, features, advantages and developments of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
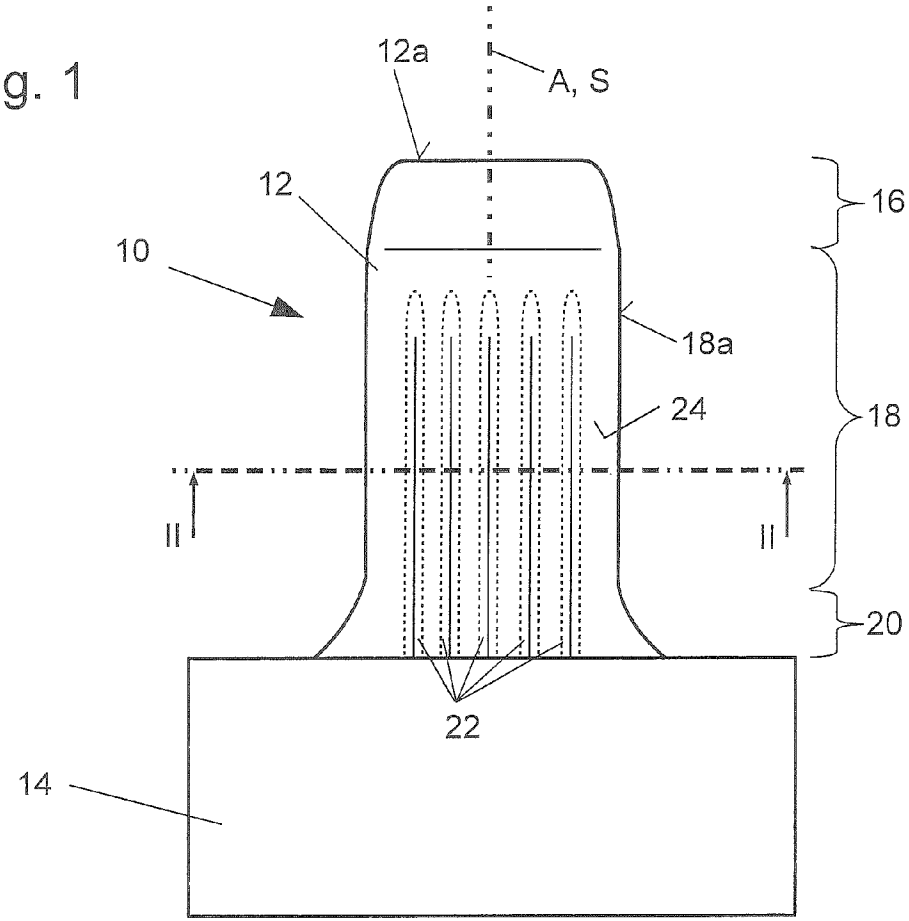
FIG. 1 is a top view of a first embodiment of an electrical plug contact of the present application.

Referring now to the drawings wherein the showings are for the purpose of illustrating preferred and alternative embodiments of the invention only and not for the purpose of limiting the same, FIG. 1 shows a first embodiment of an electrical plug contact is designated generally as 10. In the embodiment shown, the plug contact 10 comprises a contact tongue 12, which protrudes from a base segment along a protrusion axis A. The base segment 14 can serve for manipulating the plug contact 10 and can lead one or more electrical wires into the region of the contact tongue 12.

The sample contact tongue 12 comprises an inserting segment 16 extending from the free lengthwise end 12*a* to the base 14, which can be formed with one or more insertion offsets. In the example shown in FIG. 1, the insertion offset 16 tapers toward the free lengthwise end 12*a* of the contact tongue 12.

The inserting segment 16 is adjoined, in the direction toward the base 14, by a contact section 18, which is configured for the actual electrical connection with a mating plug contact. In the contact section 18, the contact tongue 12 can have an essentially constant cross section along the protruding direction from the base 14. However, the contact section 18 can also be slightly tapered away from the base 14 and toward the longitudinal end 12*a* of the contact tongue 12 to make it easier to shove a mating plug contact onto the contact tongue 12.

The contact section 18 is adjoined in the direction toward the base 14 by a foot region 20, forming the transition between the contact tongue 12 and the base 14. In the foot region 20, the cross sectional area of the contact tongue 12 can become larger toward the base 14, in order to ensure the safest and firmest possible connection of the contact tongue 12 to the base 14.

At least in the region of the contact section 18, the contact tongue 12 is formed with involvement of a plastic filled with electrically conductive filler material, such as by injection molding. One surface 18*a* of the contact section 18 is formed by the plastic filled with electrically conductive filler material, while the surface 18*a* and a very thin region lying underneath may have a lesser degree of filling with electrically conductive filler material than the interior of the contact section 18. Therefore, the skilled person also talks of a "plastic skin", which surrounds injection molded parts formed from plastic filled with electrically conductive filler material (see plastic skin 28 in FIG. 2). Due to this peculiarity, without any further measures, the plug contact 10 in the contact section 18 has an undesirably large contact resistance when the contact section 18 is contacted from the outside by an electrical conductor.

The present invention seeks to counteract this phenomenon by the configuring of at least one, preferably a plurality of sacrificial projections 22.

Figure 2:
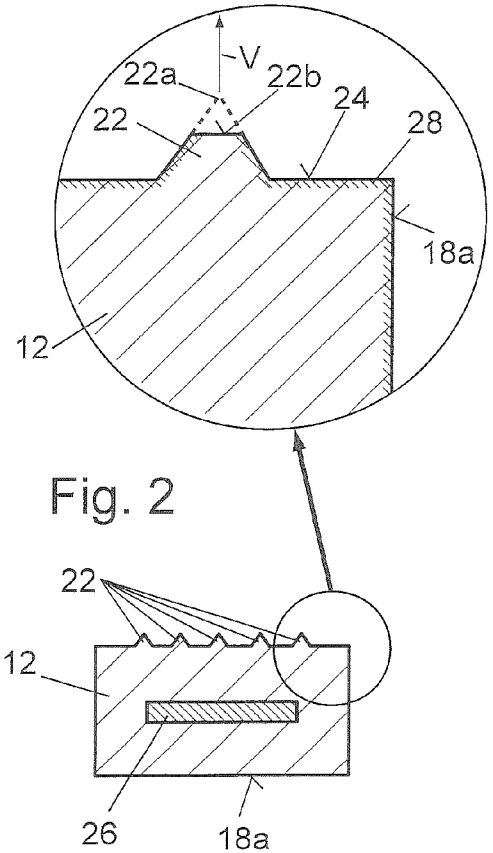
FIG. 2 is a cross sectional view through the plug contact of FIG. 1 along plane II-II.

The sacrificial projections 22, in the example shown in FIG. 1 there are five sacrificial projections 22, stand off from a base region 24 of the contact surface 18*a* of the contact section 18 formed by the surface 18*a* in the projecting direction V (also see FIG. 2). The projecting direction V in FIG. 1 is orthogonal to the plane of the drawing.

The contact tongue 12 extends in a straight line from the base along the protrusion axis A. The protrusion axis A is also a sliding axis S, along which a contact shoe 40, shown in FIGS. 4*a* and 4*b*, can be shoved as a mating plug contact onto the contact tongue 12 to make an electrically conductive connection. The shoving of the contact shoe 40 onto the contact tongue 12 is tantamount to the shoving of the contact tongue 12 into the contact shoe 40.

In the example shown in FIG. 1, the sacrificial projections 22 are fashioned as an essentially line-shaped eminence relative to the base region 30 of the contact section 18. As already explained, the sacrificial projections 22 rise up in the projecting direction V and extend essentially parallel to the protrusion axis A or the sliding axis S. "Line-shaped" means here that the longitudinal dimension, in the direction of the protrusion axis A here, is essentially larger than the dimension of the sacrificial projection in the projecting direction V and in a width direction of the respective sacrificial projection 22 orthogonal to the projecting direction V and the protrusion axis A.

The mode of functioning of the electrical plug contact 10 of FIG. 1 is explained more closely in FIG. 2. This shows a cross sectional view through the contact section 18 of the contact tongue 12 of the plug contact 10 in the plane of the drawing II-II of FIG. 1. One recognizes in the sectional view at first that the roughly hatched region of the contact tongue 12, which is formed by plastic filled with conductive filler material, can enclose an electrical conductor 26, such as a metal strip or the like. To this electrical conductor 26, an electrical conductor can be connected in the base 14, by which the electrical plug contact 10 can be connected electrically to another contact. The electrical conductor 26, however, need not be present. The contact tongue 12 can also be formed only of plastic filled with the conductive filler material.

In the magnified feature of FIG. 2, the aforementioned "plastic skin" is shown roughly as the plastic skin 28 by the fine hatched region in the vicinity of the contact surface 18*a* of the contact section 18 forming the outer surface.

Since the sacrificial projection 22 advantageously rises up only a few hundredths or tenths of a millimeter in the projecting direction above the base region 24, the sacrificial projection has an excessively large surface to volume ratio as compared to the rest of the contact section 18, so that the volume fraction occupied by the plastic skin 28 in the sacrificial projection 22 is substantially larger than that in the rest of the contact section 18. As a result, the sacrificial projection 22 has a smaller fraction of electrically conductive filler material than the rest of the contact section 18. Even so, the sacrificial projection 22 is especially suited to reducing the contact resistance of the contact section 18.

As shown in the enlarged view of FIG. 2, the sacrificial projection 22 is configured so that it is at least partly removed when making an electrically conductive connection between the plug contact 10 and a mating plug contact. The abrading can be done by any desired tool, but is done preferably by the mating plug contact shoved along the sliding axis S onto the contact tongue and thus the contact section 18 of the plug contact 10 in the case of the example of FIG. 1. As can be seen in the enlarged representation of FIG. 2, the sacrificial projection 22 is thus reduced in its projecting dimension in the projecting direction V, i.e., the abrasion occurs from the free projecting end 22*a*, situated away from the base region 24, and working toward the base region 24.

In the enlarged representation of FIG. 2, the original shape of the sacrificial projection 22 is shown by broken line. For example, a portion of this original sacrificial projection 22 has been abraded off in the above described manner by the shoving of a mating plug contact onto the contact tongue 12 of the plug contact 10. It will be recognized that this abrasion would remove the plastic skin 28 resulting in undesirably high contact resistance and thus create a separating surface 22*b* in which the electrically conductive filler material of the filled plastic is present with the usual degree of filling and is exposed by the abrasion of the material of the sacrificial projection at the separating surface 22*b* for the contacting by a mating plug contact.

Especially when the separating surface 22*b* was created by an electrically conductive segment of a mating plug contact, this can contact the electrically conductive filler material exposed at the separating surface 22*b* immediately after the mating plug contact has been shoved onto the contact tongue 12 and thus produce the electrically conductive connection between the plug contact 10 and a mating plug contact shoved onto it with a substantially smaller contact resistance.

The plug contact 10 is shown in FIG. 1 on the example of a contact tongue or a plug connector. Of course, the mating plug contact 10 can also be fashioned as a bushing. The sacrificial projections 22 are then provided in the insertion contact opening of the bushing, so that they can be partly removed by insertion of the mating plug contact.

Figure 3:
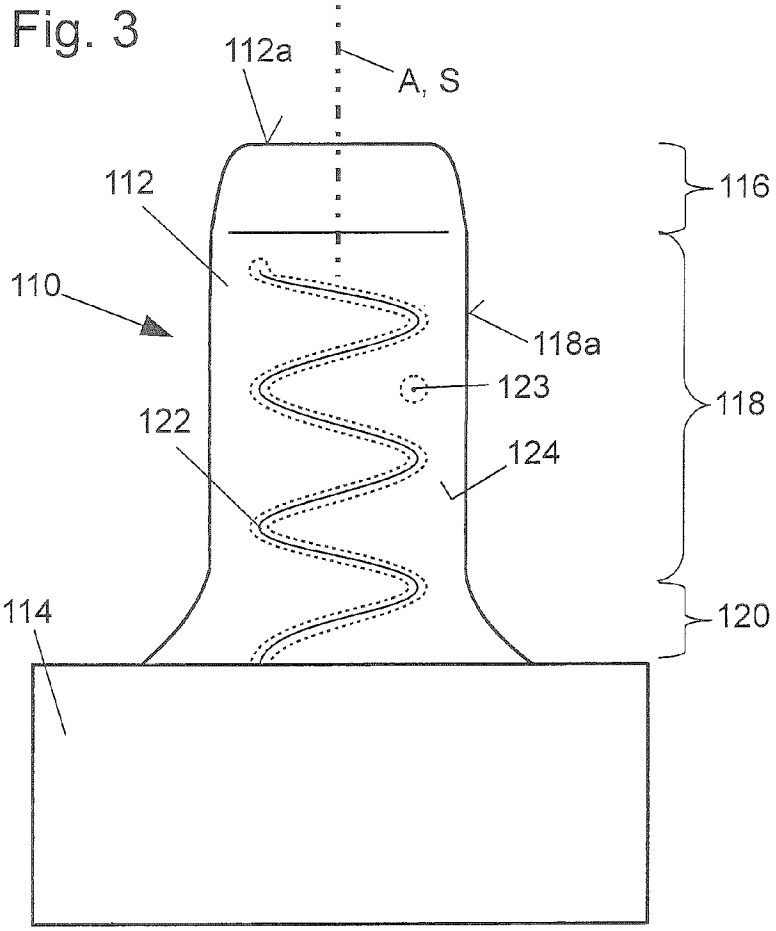
FIG. 3 is a top view of an alternative second embodiment of an electrical plug contact of the present application.

An alternative embodiment of an electrical plug contact 110 of the present invention is shown in FIG. 3. The second embodiment of FIG. 3 shall only be described below in how it differs from the embodiment of FIG. 1, otherwise making express reference to that description for the explanation of FIG. 3 as well.

The same and functionally identical parts and sections of parts in the embodiment of FIG. 1 are provided with the same reference numbers in the embodiment of FIG. 3, but increased by the number 100.

The second embodiment of the invention in FIG. 3 differs from the first embodiment in FIG. 1 solely in regard to the shapes of the sacrificial projections which are present. In FIG. 3 a sacrificial projection 122 is shown which, like the sacrificial projections 22, forms a line-shaped eminence above the base region 124, but which does not run in a straight line 20 parallel to the protrusion axis A or sliding axis S, and instead oscillates in wave fashion about an axis parallel to the protrusion axis A. In this way, nearly the entire width of one side of the contact surface 118*a* of the contact section 118 can be spanned with a single sacrificial projection 122. Thus, relatively large manufacturing tolerances are possible when making the electrical plug contacts and their mating plug contacts, since the mating plug contact in the case of such a wave-shaped sacrificial projection 122 will always have a secure abrasive action at some section of the sacrificial projection 122 even with dimensional and/or positional variations between sections of different parts, yet of the same kind.

FIG. 3 likewise shows a pointlike sacrificial projection 122 in which dimensions in directions orthogonal to each other and to the projecting direction are no longer three to four times the original dimension of the projection in the projecting direction V. Such pointlike sacrificial projections 123 can be distributed in a pattern or randomly over the contact surface 118*a*, in order to accomplish with great likelihood the at least partial removal of some of the sacrificial projections even given large manufacturing tolerances for plug contact 110 and mating plug contact.

As shown in FIG. 3, even different shapes of sacrificial projections can be provided in combination with each other on the same plug contact 10 or 110.

Figure 4A:
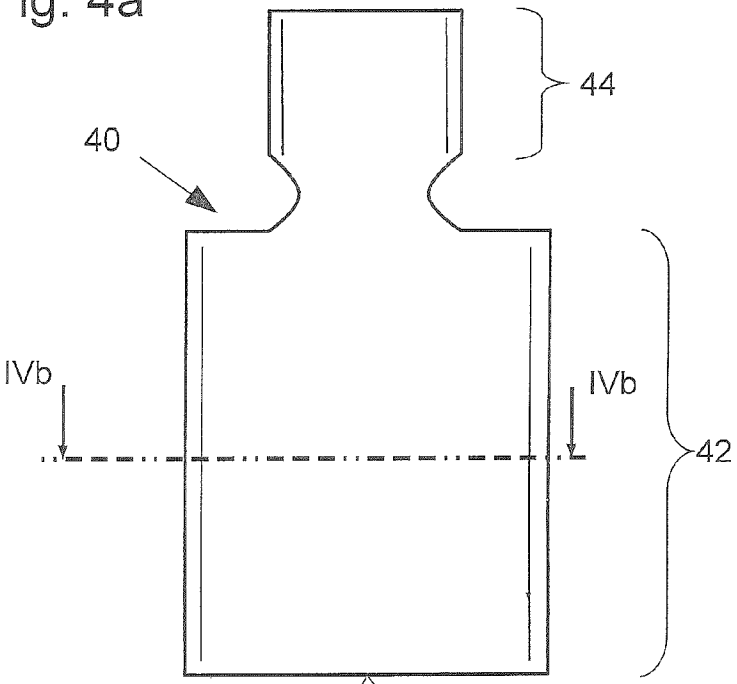
FIG. 4*a* is a top view of a mating plug contact for making an electrical connection with one of the plug contacts of FIG. 1 or FIG. 3.
Figure 4B:
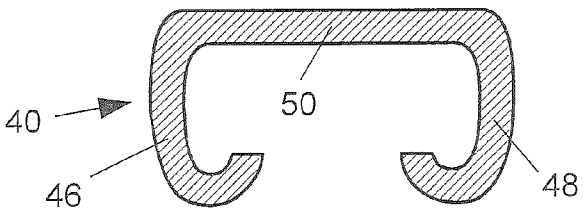
FIG. 4*b* is a cross sectional view through the mating plug contact of FIG. 4*a* along the sectioning plane IVb-IVb.

In FIGS. 4*a* and 4*b*, merely for sake of completeness, a mating plug contact 40 is shown for the making of an electrically conductive connection with the plug contact 10 and/or the plug contact 110. The mating plug contact 40 has a mating contact region 42 and a conductor holding region 44.

The mating plug contact 40, represented in FIG. 4*a* as a familiar contact shoe, can be made preferably as a single piece, especially preferably by punching and bending of metal sheet. Metal is preferred as material for making at least the mating contact section 42, being an electrical conductor with slight ohmic resistance.

As shown in FIG. 4*b*, the transverse ends of the metal sheet can be bent into spring arms 46 and 48 in the contact section 24, in order to press a preferably flat contact surface region 50 with the biasing force of the spring arms 46 and 48 against a corresponding mating surface of the contact section 18 and 118.

Thanks to this spring action, the margin 40*a* of the mating plug contact 40 moving ahead of the plug contact 10 or 110 and mating plug contact 40 when the contact tongue 12 or 112 is shoved into the mating plug contact 40 in the relative movement direction also comes to bear against the contact surface 18*a* or 118*a* of the electrical plug contact 10 or 110. Thus, the likelihood is very high that the margin 40*a* during continuing insertion of the electrical plug contact 10 or 110 into the mating plug contact will act on the sacrificial projection 22, 122 or 123 standing off from the base region 24 or 124 and remove material. For this reason, it is also preferred to leave the protruding lengthwise end 12*a* or 112*a* of the contact tongue 12 or 112 of the plug contact 10 or 110 and a region adjacent to this along the sliding axis S free of sacrificial projections. This is at least the insertion segment 16 or 116 and the partial region of the contact section 18 or 118 immediately after the insertion segment 16 or 116 in the examples of FIGS. 1 and 3.

With the above described embodiments, an electrical plug contact can be made with plastic filled by electrically conductive material and brought into electrically conductive connection with a mating plug contact with advantageously low contact resistance.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application.

Accordingly, it is to be distinctly understood that the foregoing descriptive matter is to be interpreted merely as illustrative of the invention and not as a limitation.

The invention claimed is:

1. An Electrical plug contact, which can be connected in electrically conducting manner with a mating plug contact, wherein the plug contact in at least one contact section, which is configured for the direct electrically conductive contacting with the mating plug contact, comprises a plastic filled with electrically conductive filler material, wherein the contact section has an exposed contact surface formed from the plastic filled with the electrically conductive filler material, the contact surface has a base region and a sacrificial projection region with at least one sacrificial projection opposite the base region and pointing away from its surface, which is designed to be at least partly removed when making an electrical connection with the mating plug contact, the at least one sacrificial projection, as compared to the rest of the contact section formed from the plastic filled with the electrically conductive filler material, has a smaller fraction of filler material than the rest of the contact section.

2. The electrical plug contact according to claim 1, wherein the electrical plug contact can be joined in electrically conductive contact with the mating plug contact by being shoved onto or into it along a sliding axis (S).

3. The electrical plug contact according to claim 2, wherein the at least one sacrificial projection stands out from the base region in a projecting direction with a principal component orthogonal to the sliding axis.

4. The electrical plug contact according to claim 1, wherein the at least one sacrificial projection is configured so that it is at least partly, preferably entirely removed by a region of the mating plug contact when making an electrical connection with the mating plug contact.

5. The electrical plug contact according to claim 1, wherein the sacrificial projection region comprises a plurality of separate sacrificial projections.

6. The electrical plug contact according to claim 1, wherein the at least one sacrificial projection is configured as a pointlike or line-shaped eminence.

7. The electrical plug contact according to claim 1, wherein the projecting dimension of the at least one sacrificial projection is constant along the relative movement path between plug contact and mating plug contact traveled when making an electrically conductive connection between them, preferably along the sliding axis.

8. The electrical plug contact according to claim 1, wherein the projecting dimension of the at least one sacrificial projection along a path of relative movement between plug contact and mating plug contact that is traveled when making an electrically conductive connection between the latter, preferably along the sliding axis, becomes greater in the direction of increasing overlap between plug contact and mating plug contact.

9. The electrical plug contact according to claim 1, wherein an inserting end configured for the shoving into or onto the mating plug contact and an adjacent axial inserting region is free of sacrificial projections.

10. A subassembly formed from a mating plug contact and an electrical plug contact according to claim 1.

11. The subassembly according to claim 10, wherein the mating plug contact is formed of metal at least for a segment, preferably in a mating contact section configured for the direct electrically conductive contacting of the contact section.

12. The subassembly according to claim 11, wherein a margin of the mating plug contact which moves in advance in a relative movement direction—during a relative movement between plug contact and mating plug contact to make an electrically conducting connection between the latter—is formed of metal.

13. An Electrical plug contact, which can be connected in electrically conducting manner with a mating plug contact, wherein the plug contact in at least one contact section, which is configured for the direct electrically conductive contacting with the mating plug contact, comprises a plastic filled with electrically conductive filler material, wherein the contact section has an exposed contact surface formed from the plastic filled with the electrically conductive filler material, the contact surface has a base region and a sacrificial projection region with at least one sacrificial projection opposite the base region and pointing away from its surface, which is designed to be at least partly removed when making an electrical connection with the mating plug contact, the at least one sacrificial projection is configured as a pointlike or line-shaped eminence, the at least one sacrificial projection configured as a line-shaped eminence runs along an axial section of the contact surface oscillating in wavelike or zig zag fashion in a direction orthogonal to the sliding axis and to the projecting direction.

14. An Electrical plug contact, which can be connected in electrically conducting manner with a mating plug contact, wherein the plug contact in at least one contact section, which is configured for the direct electrically conductive contacting with the mating plug contact, comprises a plastic filled with electrically conductive filler material, wherein the contact section has an exposed contact surface formed from the plastic filled with the electrically conductive filler material, the contact surface has a base region and a sacrificial projection region with at least one sacrificial projection opposite the base region and pointing away from its surface, which is designed to be at least partly removed when making an electrical connection with the mating plug contact, the projecting dimension of the at least one sacrificial projection is larger than the mean peak to valley dimension of the contact surface in the base region and smaller than 0.7 mm, preferably smaller than 0.5 mm, especially preferably smaller than 0.3 mm.

* * * * *